United States Patent [19]

Wilder et al.

[11] 4,036,259

[45] July 19, 1977

[54] FLUID DISPENSING NOZZLE

[75] Inventors: Paul R. Wilder; Chester W. Wood, both of Cincinnati, Ohio

[73] Assignee: Dover Corporation, New York, N.Y.

[21] Appl. No.: 586,192

[22] Filed: June 12, 1975

Related U.S. Application Data

[60] Continuation of Ser. No. 439,302, Feb. 2, 1974, abandoned, which is a division of Ser. No. 244,844, April 17, 1972, Pat. No. 3,817,285.

[51] Int. Cl.[2] ..... B67D 5/37

[52] U.S. Cl. ..... 137/801; 141/206; 141/392; 285/1; 285/2; 285/330

[58] Field of Search ..... 137/801; 141/206, 392; 251/151; 285/1, 2, 330, 353, 356

[56] References Cited

U.S. PATENT DOCUMENTS 3,646,974 3/1972 Moore et al. ..... 141/392

*Primary Examiner*—William R. Cline
*Assistant Examiner*—Gerald A. Michalsky
*Attorney, Agent, or Firm*—John G. Schenk

[57] ABSTRACT

An automatic nozzle having a spout which is releasably connected to the body of the nozzle in a manner so that it may be forceably removed therefrom without damage to the connecting means as well as the spout.

5 Claims, 7 Drawing Figures

FLUID DISPENSING NOZZLE

This is a continuation of application Ser. No. 439,302, filed on Feb. 2, 1974, now abandoned, which was a division of application Ser. No. 244,844 filed Apr. 17, 1972, now U.S. Pat. No. 3,817,285.

In automatic shut-off dispensing nozzles, a venturi effect is created by the flowing fluid to produce a partial vacuum within a chamber having a wall formed by a diaphragm, which cooperates with a latching mechanism. When the fluid in the tank being filled reaches a predetermined level, the venturi effect produces an increased suction in the chamber so that the diaphragm moves. As a result, the latching mechanism is moved by the diaphragm to cause closing of a poppet valve in the nozzle body to stop flow.

In one form of automatic shut-off dispensing nozzle, the venturi effect has been created by employing a fixed member to cooperate with a seat ring, which has the poppet valve engaging therewith to stop flow. This cooperation between the fixed member and the seat ring provides the desired venturi effect, but it reduces the flow rate for a particular pressure because of the resistance to the flow by the fixed member. As the flow rate increases because of further opening of the poppet valve, which stops flow when it is closed, the resistance increases.

Accordingly, when using the aforesaid arrangement for creating a venturi effect to automatically shut off flow through a fluid dispensing nozzle when a predetermined level in the tank being filled is reached, the sizes of the hoses and the nozzle body have been determined in accordance with the flow desired through the nozzle. To compensate for the resistance by the fixed member, which cooperates with the seat ring to produce the venturi effect, the sizes of the nozzle body and the hoses have been larger than would have been necessary if there were no fixed member present. Thus, for a nozzle utilizing an automatic shut-off member present the size of the elements has been larger than that necessary for the same flow from a nozzle not having an automatic shut-off arrangement.

The present invention satisfactorily solves the problem of the resistance to the flow of the fluid through the nozzle body while still obtaining the desired venturi effect to obtain automatic shut-off when the fluid in the tank or container, which is being filled, reaches a predetermined level. With the present invention, the sizes of the nozzle body and the hoses may be reduced in comparison with the presently available nozzles having an automatic shut-off arrangement.

Tests of a nozzle using the present invention have indicated that the flow rate is significantly increased in comparison with the flow through the same nozzle utilizing the presently available automatic shut-off assemblies. For example, the present invention will permit reduction of the hose size from 1 inch to ¾ inch and obtain the same flow. This permits reduction of the cost of the nozzle body and the hoses.

Furthermore, this decreases the weight of the nozzle and the connected elements for a particular desired flow rate. As a result, the nozzle may be more easily handled than the presently available nozzles with an automatic shut-off arrangement.

Since there is a tendency toward self service in gasoline service stations, the present invention is particularly useful in such operations since it is lighter and may be easily handled, even by a woman. Thus, the normal deterrent of the weight of the nozzle is significantly decreased by the nozzle of the present invention even though having an automatic shut-off arrangement.

The present invention accomplishes the desired venturi effect of automatic shut-off with smaller passages and the same flow rate as previously available nozzles having an automatic shut-off arrangement by utilizing a secondary poppet valve, which is resiliently biased in the opposite direction to the direction in which the main poppet valve is resiliently biased. The secondary poppet valve cooperates with the seat ring to form the venturi effect for automatic shut-off.

By utilizing a secondary venturi effect on the secondary poppet valve, the resistance of the secondary poppet valve to the flow is decreased as the flow increases because of the reduced pressure produced by the secondary venturi effect in a chamber within the secondary poppet valve. Therefore, the present invention does not maintain a fixed resistance to the fluid flow but has a decreasing resistance as fluid flow increases. Accordingly, this enables a greater fluid flow to occur for a predetermined hose size.

As previously mentioned, the present invention produces a nozzle body of lesser weight than presently available nozzle bodies having an automatic shut-off arrangement. To further decrease the weight of the nozzle body, the present invention utilizes a lightweight support for the latch retaining mechanism rather than using a portion of the nozzle body. This aids in reducing the weight of the nozzle body. As a result, the nozzle of the present invention is particularly useful for self service operations.

Since the person, who is filling his own vehicle tank, is not experienced, the possibility exists that the person could fail to remove the spout of the nozzle from the vehicle upon finishing. If this were to occur and the vehicle were to be moved, substantial damage could occur to the nozzle body and the hoses if the spout were fixed to the nozzle body.

The present invention satisfactorily meets this problem by utilizing a nozzle spout which is releasably connected to the nozzle body. As a result, the spout may be easily replaced in the nozzle body if the spout should be left in the vehicle when the vehicle moved. Thus, with the present invention, there is no damage to the nozzle body or to the hoses connected thereto if the spout should be left in a vehicle tank and the vehicle moved since the spout will be automatically pulled from the nozzle body without damage.

Since some service station operations may have self service at some times and attendant service at other times, it is desirable to be able to utilize the advantages of the attendant not having to hold the handle of the nozzle during filling while still requiring such attention from a person, who is filling his own tank. By enabling the attendant to not have to hold the handle while filling the vehicle, the attendant can attend to other chores such as checking the oil, for example.

The nozzle of the present invention is capable of meeting these requirements. The present invention has a rack, which is adjustable movable, for cooperation with a retaining mechanism of the handle to hold the handle in a position in which the fluid may flow through the nozzle without the attendant having to hold the handle when the rack is in one position. In another position the retaining mechanism cannot cooperate with the rack so that it is necessary for the handle to be held for any fluid flow to occur through the nozzle. Accordingly, this latter position would be utilized when there is to self service.

With the shut-off mechanism utilized with the present invention, fluid flow is automatically stopped even when the rack is positioned so that the retaining mechanism cannot cooperate therewith. Thus, during self service, even if the inexperienced person fails to release the handle when the tank is filled, there cannot be any overflow because of the automatic shut-off arrangement utilized with the nozzle body of the present invention.

An object of this invention is to provide a fluid dispensing nozzle having an increased flow for a particular size passage.

Another object of this invention is to provide a fluid dispensing nozzle of lighter weight for a particular flow rate.

A further object of this invention is to provide a fluid dispensing nozzle usable for self service or attendant operation.

Other objects, uses, and advantages of this invention are apparent upon a reading of this description, which proceeds with reference to the drawing forming part thereof and wherein.

Figures 1, 2, 3:
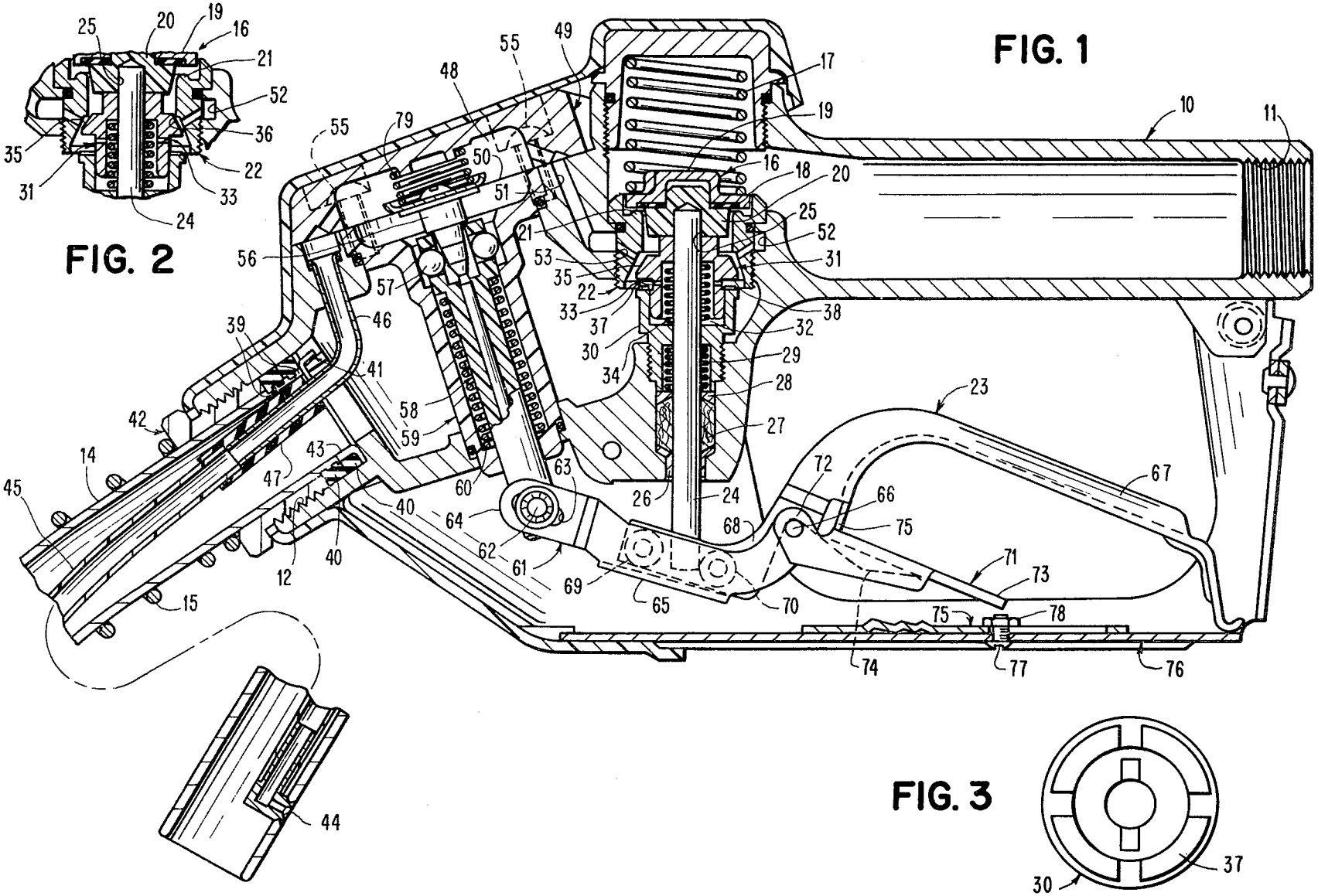
FIG. 1 is a sectional view, partly in elevation, of the nozzle of the present invention.
FIG. 2 is a fragmentary sectional view showing the relationship of the secondary poppet valve and the seat ring when the secondary poppet valve engages the seat ring.
FIG. 3 is a top plan view of a retainer that supports the secondary poppet valve.

Referring to the drawing and particularly FIG. 1, there is shown a nozzle body 10 having an inlet 11 to which a hose is connected to supply fluid to the body 10 and an outlet 12 to which a spout 14 is connected for dispensing the fluid to a container. The spout 14 has a spring 15 thereon to contact the filler pipe of the container or tank being filled.

The body 10 has a first or main poppet valve 16 supported therein for stopping or preventing flow of fluid through the body 10 from the inlet 11 to the outlet 12. A spring 17 continuously urges the first poppet valve 16 to its closed position in which flow from the inlet 11 to the outlet 12 is stopped or prevented.

The first poppet valve 16 includes a sealing disc 18, which is formed of a resilient material such as rubber, for example, a retainer or holder 19, and a skirt 20, which is formed of a suitable plastic or metal. The sealing disc 18 of the first poppet valve 16 engages a first valve seat 21 of a seat ring 22, which is supported within the body 10 by being threaded thereto when the first poppet valve 16 is in its closed position.

The first poppet valve 16 is moved to an open position by a pivotally mounted handle 23 moving a stem 24, which has its upper end disposed within a passage 25 in the skirt 20. The amount of upward movement of the first poppet valve 16 determines the rate of flow through the seat ring 22 since the skirt 20 has its side surface machined with a specific contour for cooperation with the wall of the seat ring 22.

The stem 24 passes through the body 10 for cooperation with the handle 23 but not in contact with the body 10 because of a guide 26 being disposed in surrounding relation to the stem 24 as it extends exteriorly of the body 10. The guide 26 is formed of a suitable plastic material such as acetal resin, for example. This material has a relatively low coefficient of friction that minimizes the sliding friction between the stem 24 and the body 10. The guide also eliminates wear on the stem 24 so as to not affect the sliding action of the stem 24.

Fluid cannot flow from the body 10 to the exterior thereof through the passage in the body 10 for the stem 24 due to a packing 27, which is disposed in surrounding relation to the stem 24 and above the guide 26. A gland 28 is disposed above the packing 27 and has a spring 29 acting thereon. A retainer 30, which is threaded in the body 10, acts against the spring 29 and retains the packing 27 in a position to prevent any leakage of fluid from the body 10 through the stem 24.

The retainer 30 slidably supports the lower end of a second or secondary poppet valve 31. The second poppet valve 31 and the retainer 30 cooperate to form a chamber 32 therebetween having communication to the interior of the body through passages 33 in the second poppet valve 31.

A spring 34 is disposed within the chamber 32 and continuously urges the second poppet valve 31 into engagement with the bottom surface of the skirt 20 of the first poppet valve 16. The stem 24 extends through the second poppet valve 31 so that there is a sliding relation therebetween whereby the second poppet valve 31 can move axially relative to the stem 24.

Accordingly, when the first poppet valve 16 is moved upwardly by pivoting the handle 23, the second poppet valve 31 follows this movement of the first poppet valve 16 until a surface 35 of the second poppet valve 31 engages a second valve seat 36 of the seat ring 22. This engagement of the surface 35 of the second poppet valve 31 with the second valve seat 36 of the seat ring 22 is shown in FIG. 2.

As flow of the fluid starts through the seat ring 22 due to the first poppet valve 16 being moved upwardly against the force of the spring 17 until the retainer 19 causes to contact the seat ring 22, the pressure of the fluid moved the second poppet valve 31 downwardly so that the surface 35 of the second poppet valve 31 no longer engages the second valve seat 36 of the seat ring 22. As a result, fluid flows through the body 10 to the outlet 12 and then through the spout 14 to the container to be filled.

Because of the flow of fluid through the body 10 and the passages 33 in the second poppet valve 31 providing communication between the chamber 32 and the interior of the body 10, a venturi effect is created by the fluid flowing over the lower edge of the surface 35 of the second poppet valve 31 to produce a vacuum within the chamber 32. This decreases the total pressure acting upwardly on the second poppet valve 31 whereby the second poppet valve 31 is moved further away from the second valve seat 36 of the seat ring 22 to allow an increased flow of the fluid through the body 10 for a particular pressure of the fluid.

The upper end of the retainer 30 has four protruding portions 37 (see FIG. 3) for cooperation with a lower annular surface 38 of the second poppet valve 31 to limit the downward movement of the second poppet valve 31. This insures that the passages 33 always communicate with the interior of the body 10 even when the second poppet valve 31 is in its lowermost position to allow maximum flow between the seat ring 22 and the second poppet valve 31.

The spout 14 is releasably connected to the body 10. The spout 14 has its upper end formed with projections 39 for cooperation with packing 40, which is preferably formed of rubber. The packing 40 is retained between a lock washer 41 and a retainer 42, which is formed of a suitable plastic or metal, threadedly disposed in the outlet 12 of the body 10. The lock washer 41 has a portion 43 cooperating with a slot in the end of the spout 14 to prevent the spout 14 from rotating relative to and maintaining alignment with the body 10.

If the spout 14 should be retained in a vehicle tank when the vehicle is moved, the projections 39 on the spout 14 will be pulled out of the packing 40 without any damage to the body 10, to the pump to which the body 10 is connected by a hose, or to the hose. To replace the spout 14 in the body 10, it is only necessary to remove the retainer 42 and insert the end of the spout 14 so that the projections 39 penetrate in the packings 40.

Whenever the spout 14 is pulled loose, a vacuum tube 45, which is supported in the spout 14 and has one end communicating with an opening 44 in the spout 14, also is disconnected from its connection with an elbow tube 46, which is supported in the body 10. The vacuum tube 45 is connected to the elbow tube 46 by a coupling 47, which is preferably formed of rubber.

The vacuum tube 45 and the elbow tube 46 form a passage leading from the tank of the vehicle being filled to a chamber 48, which is formed between a cap 49 and a diaphragm 50. The chamber 48 also communicates through a passage 51 in the body 10, an annular chamber 52 in the body 10, and four passages 53, (two shown in FIG. 1) in the seat ring 22 to the interior of the seat ring 22.

Accordingly, when the fluid flows from the inlet 11 to the outlet 12, a venturi effect is created in the passages 53 in the seat ring 22. Thus, as long as the opening 44 is not closed due to the fuel in the tank reaching a predetermined level to indicate that the tank is filled, the venturi effect created by the flow of the fluid between the seat ring 22 and the second poppet valve 31 draws air through the vacuum tube 45. However, as soon as the opening 44 is blocked, the chamber 48 has its pressure reduced due to the air therein being drawn therefrom because of the venturi effect in the passages 53 in the seat ring 22. This venturi effect is more particularly described in U.S. Pat. No. 2,582,195 to L. H. Duerr.

The diaphragm 50 and the cap 49 are secured to the body 10 by screws 55. Thus, the diaphragm 50 is held between the body 10 and the cap 49 to form the chamber 48.

The diaphragm 50 has a latch retaining pin 56 secured thereto for movement therewith and disposed between three balls 57 (two shown), which are positioned within passages in a latch plunger 58. When the retaining pin 56 is in the position shown in FIG. 1, the balls 57 prevent downward movement of the plunger 58, which is slidably mounted within an insert 59. The insert 59, which is preferably formed of a plastic, is supported in the body 10.

When the diaphragm 50 is moved upwardly due to the tank being filled, the retaining pin 56 is moved upwardly therewith. The upward movement of the retaining pin 56 disposes a tapered portion of the retaining pin 56 between the balls 57 whereby the balls 57 may move inwardly to allow the plunger 58 to be moved downwardly against the force of its spring 60. The correlation between the tapered portion of the pin 56 and the latch plunger 58 is more specifically shown in U.S. Pat. No. 2,582,195 to Duerr.

The lower end of the plunger 58 is connected to a lower lever 61 by a pin 62. The pin 62, which is secured to the plunger 58, extends through slots (one shown at 63) in bifurcated portions (one shown at 64) of the lower lever 61 to provide a pin end slot connection between the plunger 58 and the lever 61. Thus, the lower lever 61 can both pivot and slide relative to the latch plunger 58.

The bifurcated portions of the lower lever 61 are spaced from each other for a greater distance adjustment the stem 24. The bifurcated portions are secured to each other by a channel portion 65, which is disposed beneath the stem 24 and engages the bottoms of the greater spaced parts of the bifurcated portions of the lower lever 61. The upper surface of the channel portion 65 is adapted to engage the lower end of the stem 24, which has a plastic button (not shown) therein for engagement with the upper surface of the channel portion 65 to reduce friction during the sliding relation between the lower lever 61 and the stem 24, when the lower lever 61 is moved.

The lower lever 61 is pivotally connected to the handle 23 by a rivet 66. The handle 23 includes a gripping portion 67 having a pair of bifurcated arms (one shown at 68) extending from opposite sides of the gripping portion 67. The ends of the bifurcated arms of the handle 23 are connected to each other so that only the end of one of the arms engages the upper surface of the channel portion 65 of the lower lever 61. The bifurcated arms of the handle 23 have rollers 69 and 70 supported therebetween for cooperation with the lower end of the stem 24 so as to enable the stem 24 to be maintained in its vertical position irrespective of the movements of the handle 23.

When the handle 23 is raised from the position of FIG. 1, the lower lever 61 is moved therewith because of the pivotal connection through the rivet 66. As the handle 23 is raised upwardly, the end of one of the bifurcated arms of the handle 23 engages the upper surface of the channel portion 65 of the lower lever 61. Accordingly, the handle 23 and the lower lever 61 function as a single unit at this time and pivot about the axis of the pin 62. The latch plunger 58 is locked at this time due to the position of the retaining pin 56 with respect to the balls 57.

As the handle 23 moves upwardly, the channel portion 65 of the lower lever 61 engages the valve stem 24 to move it upwardly against the force of the spring 17 to open the first poppet valve 16. This allows fluid to flow from the inlet 11 to the outlet 12 of the body 10 with the pressure of the fluid moving the second poppet valve 31 away from the second valve seat 36.

The handle 23 may be held in any of three positions to provided different flow rates by a trigger 71, which is pivotally mounted on the rivet 66; thus, the trigger 71 is pivotally connected to both the lower lever 61 and the handle 23. The trigger 71 includes a pair of bifurcated ears (one shown at 72) disposed on opposite sides of the bifurcated portion of the lower lever 61. The bifurcated ears of the trigger 71 are connected to each other by a central connecting portion 73.

The trigger 71 is continuously urged counterclockwise about the axis of the rivet 66 by a spring 74, which is supported on the rivet 66 between the bifurcated arms of the handle 23, acting on the central connecting portion 73 of the trigger 71. The counterclockwise movement of the trigger 71 by the spring 74 is limited by engagement of the central connecting portion 73 with a depending tab 75 on the handle 23.

When it is desired to lock the handle 23 in a position in which the first poppet valve 16 is held open, the central connecting portion 73 of the trigger 71 is disposed in engagement with one of the notches or steps on a rack 75. The rack 75 is adjustably connected to a guard 76, which is secured to the nozzle body 10, by a screw 77 and a nut 78.

Accordingly, when it is desired to have fluid flow without the user having to hold the handle 23 so that flow occurs until there is automatic shut-off, the rack 75 is positioned as shown in FIG. 1. This would be when the nozzle is being handled by an experienced operator.

When it is desired to require the user to hold the handle 23 to have any fluid flow, the rack 75 may be adjusted forwardly through releasing the nut 78 so that the rack 75 may be advanced to a position in which the trigger 71 cannot cooperate with the steps of the rack 75. This would be when self-service would be employed whereby one would have to continue to hold the handle 23 to have flow of fluid through the dispensing nozzle.

When the rack 75 is disposed as shown in FIG. 1 and the trigger 71 cooperates with one of the steps or notches thereof, the trigger 71 holds the handle 23 in the desired position until the tank is filled. When this occurs, the opening 44 in the spout 14 is blocked by the lever of the fluid in the tank whereby the latch plunger 58 is released from the balls 57 due to the diaphragm 50 being moved upwardly because of the reduced pressure in the chamber 48.

When the plunger 58 is released, the force of the spring 17 closes the first poppet valve 16 by moving the lower lever 61 counterclockwise about the rivet 66. This pulls the plunger 58 downwardly.

Because the handle 23 is held against movement by the trigger 71 being disposed in the rack 75, the lower lever 61 pivots counterclockwise about the rivet 66 during the downward movement of the stem 24. When the trigger 71 ceases to have sufficient force exerted thereon so that the trigger 71 no longer has sufficient frictional engagement with the notch or step of the rack 75 to remain engages therewith, the spring 74 pivots the trigger 71 counterclockwise until the central connecting portion 73 of the trigger engages the tab 75 of the handle 23.

When the trigger has its end released from the notch or step of the rack 75, the handle 23 falls. As a result, the plunger spring 60 returns the plunger 58 to the position of FIG. 1. This results in the lower lever 61 being returned to the position of FIG. 1 wherein the channel portion 65 engages the end of one of the bifurcated arms of the handle 23.

If the spout 14 has been moved from the tank being filled the opening 44 is no longer blocked. As a result, the pressure in the chamber 48 increases to allow a diaphragm spring 79, which continuously acts on the upper surface of the diaphragm 50 to urge the diaphragm 50 downward, and return the retaining pin 56 to the position shown in FIG. 1 in which the plunger 58 is locked against downward movement.

Even if the handle 23 is held during the entire filling operation rather than utilizing the trigger 71, the mechanism of the present invention still stops flow to the tank when the tank becomes filled. This is because the lower lever 61 pivots counterclockwise about the rivet 66 when the latch plunger 58 is no longer held by the balls 57. Therefore, the spring 17 still moves the stem 24 downwardly against the lower lever 61 and causes the lower lever 61 to pivot counterclockwise about the axis of the rivet 66 even though the handle 23 is being held by the user.

Considering the operation of the present invention, fluid flow is started by lifting the handle 23 whereby the first poppet valve 16 is moved upwardly so that the sealing disc 18 no longer engages the first valve seat 21 of the seat ring 22. Since the second poppet valve 13 has its upper end urged against the lower surface of the skirt 20 of the first poppet valve 16 by the spring 34, the second poppet valve 31 moves upwardly with the first poppet valve 16 until the surface 35 of the second poppet valve 31 engages the second valve seat 36 of the seat ring 22 as shown in FIG. 2.

As soon as the sealing disc 18 of the first poppet valve 16 ceases to engage the first valve seat 21 of the seat ring 22 so that fluid can flow therebetween, the pressure of the fluid pushes the second poppet valve 31 downwardly against the force of the spring 32 so that the surface 35 no longer engages the second valve seat 36 of the seat ring 22.

As the fluid flows between the inner wall of the seat ring 22 and the second poppet valve 31, a venturi effect is created for the passages 52. When the fluid flows over the lower edge of the surface 35 of the second poppet valve 31, a secondary venturi effect is created for the passages 33. As a result, a vacuum is produced within the chamber 32 so that the forces acting upwardly on the poppet valve 31 are reduced whereby a greater flow of fluid through the body 10 can occur.

When the handle is released or the tank becomes filled so that the diaphragm 50 moves upwardly whereby the lower lever 61 no longer holds the bottom of the stem 24 in the position in which the first poppet valve 16 is in an open position, the spring 17 returns the first poppet valve 16 to its closed position. This stops fluid flow through the body 10.

When the fluid flow through the body 10 stops, the second poppet valve 31 returns to the position of FIG. 1 in which it abuts against the bottom surface of the skirt 20 of the first poppet valve 16. In this position, there is no fluid trapped between the first poppet valve 16 and the second poppet valve 31 so that all of the fluid can flow from the body 10 to the tank being filled.

Figure 4:
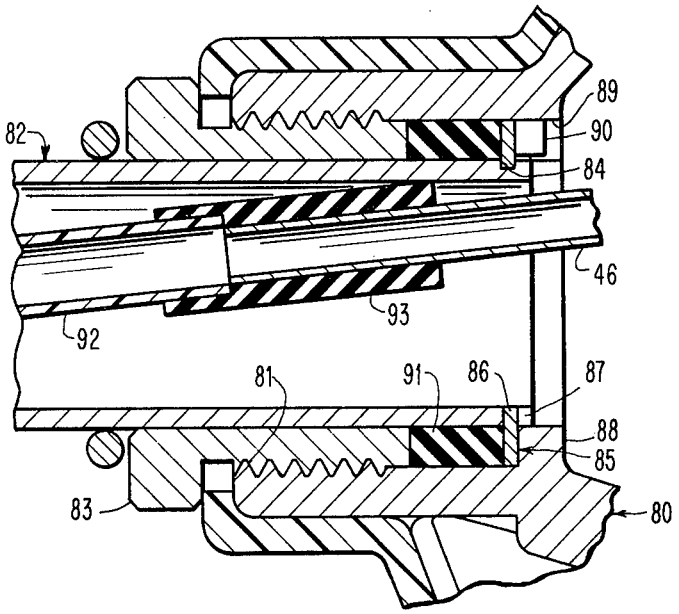
FIG. 4 is a fragmentary sectional view of a modification of the spout and nozzle body of the present invention.
Figure 5:
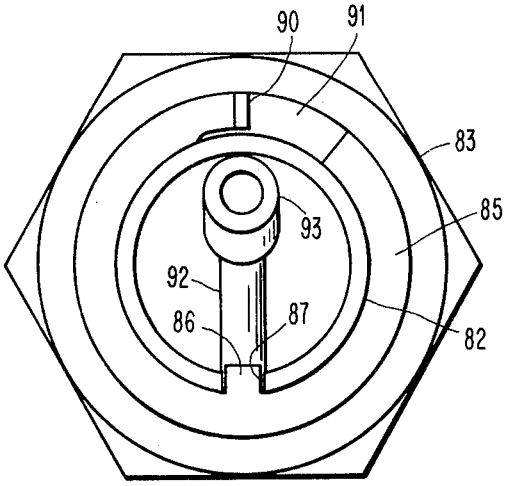
FIG. 5 is an end elevational view of the spout of FIG. 4.

While the present invention has shown the spout 14 as being releasably connected to the nozzle body 10 so that it can be removed therefrom when subjected to a sufficient force, it should be understood that the present invention may be employed with a nozzle body in which the spout is not removable when subjected to a force. Referring to FIGS. 4 and 5, there is shown a nozzle body 80, which is the same as the nozzle body 10 except in the area shown in FIG. 4.

The nozzle body 80 has an outlet 81 within which is disposed a spout 82. The spout 82 is releasably connected to the nozzle body 80 by a retainer 83, which is preferably formed of aluminum, and is threadedly disposed in the outlet 81 of the body 80.

The spout 82 has a continuous groove 84 formed in its outer surface adjacent its end, which is disposed within the body 80. The groove 84 has a lock washer 85 supported therein.

The lock washer 85 is retained in a predetermined position on the spout 82 through having a tab 86 of the lock washer 85 disposed in a slot 87, which is formed in the end of the spout 82 and communicates with the groove 84. Accordingly, the lock washer 85 is fixedly retained in a predetermined position on the spout 82.

Figure 6:
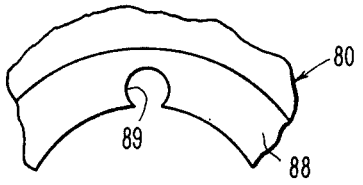
FIG. 6 is an end elevational view of a portion of the body in which the spout of FIG. 4 is mounted.

The lock washer 85 abuts against an annular portion 88 of the nozzle body 80 to limit the movement of the spout 82 into the nozzle body 80. The annular portion 88 has a semi-circular hole 89 (see FIG. 6) formed therein at a predetermined position to receive a tab 90 (see FIGS. 4 and 5) on the lock washer 85 when the spout 82 is positioned so that the lock washer 85 abuts against the annular portion 88 of the body 80. The cooperating relation between the tab 90 of the lock washer and the hole 89 in the annular portion 88 of the body 80 positions the spout 82 in the desired alignment and prevents rotation thereof.

The spout 82 has a packing 91, which is preferably formed of rubber, in surrounding relation thereto and abutting against the lock washer 85. When the retainer 83 is threaded in the outlet 81 of the body 80 to hold the spout 82 in the body 80, the packing 91 is retained between the lock washer 85 and the end of the retainer 83 as shown in FIG. 4.

The spout 82 has a vacuum tube 92 supported therein in the same manner as the vacuum tube 45 is supported in the spout 14. Furthermore, the vacuum tube 92 is connected to the elbow tube 46, which is supported in the nozzle body 80 in the same manner as in the body 10, by a sleeve 93, which is preferably formed of rubber.

Accordingly, the releasable connection of the spout 82 to the nozzle body 80 enables quick replacement of the spout 82 whenever desired. It is only necessary to disconnect the retainer 83 and pull the spout 82 from the body 80. The sleeve 93 will cease to engage the elbow tube 46. Another of the spouts 82, which has the vacuum tube 92 and the sleeve 93 mounted therein, can then be inserted into the body 80.

Figure 7:
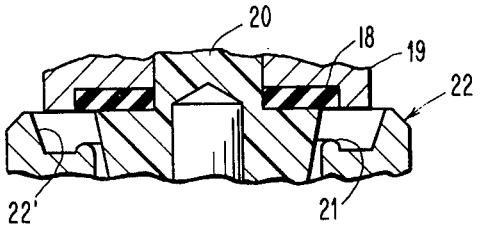
FIG. 7 is a fragmentary sectional view of a modification of the main poppet valve and its seat ring.

As shown in FIG. 7, the seat ring 22 may have its upper end formed with an inclined wall 22'. Accordingly, as the first poppet valve 16 is moved towards its closed position, throttling occurs between the retainer 19 of the first poppet valve 16 and the wall 22' of the seat ring 22. This gives further control of the rate of flow through the seat ring 22 beyond that obtained by the cooperation of the skirt 20 with the seat ring 22.

An advantage of this invention is that it permits reduction of the weight of the nozzle and its components for a particular quantity of flow. Another advantage of this invention is that it is a less expensive nozzle for a particular rate of flow since the cost of the nozzle body, hoses, and the like are reduced.

For purposes of exemplification, a particular embodiment of the invention has been shown and described according to the best present understanding thereof. However, it will be apparent that changes and modifications in the arrangement and construction of the parts thereof may be restored to without departing from the spirit and scope of the invention.

What is claimed is:

1. A body having a valve to control flow therethrough, a spout to dispense fluid from said body, said spout having one end disposed within said body, means to releasably connect said spout to said body to prevent relative movement between said spout and said body unless said spout is subjected to a sufficient force to remove said spout from said releasably connecting means and said body, alignment means cooperatively engaging said one end of said spout and said body in a fixed manner to positively prevent rotation of said spout and maintain alignment of said spout relative to said body without preventing removal of said spout when said spout is subjected to the sufficient force to remove said spout from said releasably connecting means said body, and said alignment means including means to cooperate with said one end of said spout and said body to limit the movement of said spout into said body, said releasably connecting means being resilient so that forceable removal of said spout will not damage said connecting means.

2. The body according to claim 1 wherein said one end of said spout has a slot therein, and said alignment means has a portion for disposition in said slot.

3. A body having a valve to control flow therethrough, a spout to dispense fluid from said body, means to releasably connect said spout to said body, alignment means cooperatively engaging one end of said spout and said body in a fixed manner to positively prevent rotation of said spout and maintain alignment of said spout relative to said body, said releasably connecting means including means in said body to releasably receive the one end of said spout, means to retain said releasably receiving means in said body even when said spout is subjected to a sufficient force to remove the one end of said spout from said releasably receiving means and said body, said releasably receiving means being a packing material and said one end of said spout is formed with projections for cooperation with said packing material.

4. The body according to claim 3 in which said retaining means is a retainer threadedly disposed in said body and about said one end of said spout, the end of said retainer engaging said packing material and urging said material against said alignment means.

5. The body according to claim 4 in which said one end of said spout is formed with a slot therein and in which said alignment means is an annular member having a projecting portion to engage the slot in said spout, said member having a second portion engaging said body to fixedly position said member.

* * * * *